US005785246A

United States Patent [19]

King et al.

[11] Patent Number: 5,785,246

[45] Date of Patent: Jul. 28, 1998

[54] VARIABLE FLOW SPRINKLER HEAD

[75] Inventors: Bradley A. King; Gary L. Foster, both of Aberdeen; Dennis C. Kincaid, Kimberly; Rodney B. Wood, Soda Springs, all of Id.

[73] Assignee: Idaho Research Foundation, Inc., Moscow, Id.

[21] Appl. No.: 650,295

[22] Filed: May 20, 1996

[51] Int. Cl.[6] ..... B05B 1/08

[52] U.S. Cl. ..... 239/11; 239/101; 239/380; 239/518

[58] Field of Search ..... 239/101, 11, 99, 239/583, 380, 222, 728–731, 584, 585.4, 585.5, 524, 518

[56] References Cited

U.S. PATENT DOCUMENTS

| | | | |
|---|---|---|---|
| 3,061,198 | 10/1962 | Kerr et al. | 239/380 X |
| 3,094,711 | 6/1963 | Douglas et al. | 239/222.11 X |
| 4,015,366 | 4/1977 | Hall, III | 47/1 R |
| 4,392,812 | 7/1983 | Yoshii | 239/585.5 X |
| 4,842,162 | 6/1989 | Merkel | 222/1 |
| 4,982,897 | 1/1991 | Matusita et al. | 239/583 X |
| 5,052,620 | 10/1991 | Rinkewich | 239/101 X |
| 5,224,653 | 7/1993 | Nelson et al. | 239/222.11 X |
| 5,246,164 | 9/1993 | McCann et al. | 239/11 |
| 5,314,164 | 5/1994 | Smith | 251/129.17 |

*Primary Examiner*—Kevin Weldon

*Attorney, Agent, or Firm*—Joseph W. Holland; Craig M. Korfanta

[57] ABSTRACT

A variable flow sprinkler head having an inlet, an outlet and a nozzle, the nozzle having an orifice therein, the cross sectional area of the orifice being changeable by alternately inserting or removing a needle into the sprinkler head nozzle orifice. The needle diameter is sized to provide a predetermined flow rate reduction when the needle is inserted into the nozzle orifice. When the needle is removed full flow occurs. When the needle is inserted into the center of the nozzle orifice, the cross sectional area is effectively reduced by an amount equal to the cross sectional area of the needle. A linear actuator for the needle is centered above the outlet. The linear actuator may be either an electric solenoid or a hydraulic actuator. Alternatively, the linear actuator may provide a mechanism to allow the sprinkler to be operated between either of two preselected flow rates or in the alternative to be shut off completely.

12 Claims, 7 Drawing Sheets

VARIABLE FLOW SPRINKLER HEAD

This invention was funded in part by the United States Department of Agriculture under Grant No. 93-34214-8861; The United States has certain rights in the invention.

BACKGROUND OF THE INVENTION

1. Technical Field

The present invention relates generally to sprinkler irrigation and more specifically to an apparatus for irrigation which provides a means for varying the flow rate of a sprinkler head used for water and chemical application by cycling a pin in and out of a sprinkler head nozzle to achieve a desired flow rate.

2. Background

Concern regarding water conservation increases daily. Irrigated agriculture is the largest consumptive user of water in the nation. Agricultural uses of water are significant and increasing. Therefore it follows that the public's concerns relative to water conservation in agriculture are significant and increasing.

In recent years there has been a trend in the U.S. away from surface or gravity irrigation systems to pressurized irrigation systems, primarily sprinklers. Sprinkler systems usually have better uniformity of water application than do surface systems, and they are more easily adapted to automatic control. Another advantage sprinkler systems possess is the capability of applying agricultural chemicals through the water (chemigation). This provides a convenient and relatively inexpensive method of applying chemicals whenever desired without any additional machinery traffic in the field.

Irrigation equipment in common use today can generally be categorized as follows: continuously moving systems, such as center pivot systems, linear move systems, and stationary solid set sprinkler lines, and wheel lines. Each of these systems are reviewed briefly here. A more complete treatment of various types of irrigation systems is provided in McCann et. al., U.S. Pat. No. 5,246,164 which is incorporated by reference herein.

Generally speaking, there are two types of "moving" systems, the center pivot system and the linear move system. The above systems are termed "moving" systems, in contrast to "stationary" systems, in which the lateral does not move during irrigation. In addition to advantages such as low labor requirements and ease of chemigation, moving systems typically offer greater irrigation uniformity compared to other available systems.

The center pivot system usually embodies a supply line through which irrigation water is pumped, under pressure, to a fixed central pivot to a horizontal sprinkler lateral, which extends radially out from the central pivot assembly. The lateral is supported by a plurality of movable support towers, such that the lateral can be rotated about the central pivot tower assembly. A plurality of sprinkler assemblies are connected to outlets at spaced intervals along the lateral, thus forming a fixed array which is movable. When the main irrigation water supply line and irrigation line are pressurized with a supply of irrigation water, the sprinklers operate automatically to sprinkle the water out over zones of the field located beneath the sprinklers. Distribution patterns are determined by the spacing of the sprinkler heads, the spacing typically being greater close to the pivot point and decreasing towards the end where flow rates per unit length are larger. Distribution patterns are also determined by nozzle size.

While a center-pivot irrigation system can be sized to irrigate a circular or arcuate section of a field of virtually any size, typically they are sized to irrigate fields of approximately 160 acres, commonly called quarter sections, utilizing seven to fifteen movable towers supporting the lateral having between 100 and 150 sprinkler assemblies.

The second common type of continuously moving self-propelled system is the linear move system, wherein a main irrigation water supply line is positioned along one side or the center of the field, and a sprinkler lateral, supported at spaced intervals by movable towers and/or wheels extends out normal to the main irrigation line and transverse across the field. As with the center pivot irrigation system, a plurality of sprinkler assemblies are provided at spaced intervals along the sprinkler lateral. Hydraulic connection between the main irrigation supply system and the sprinkler lateral is commonly provided by means of a suction pipe in a canal, or a flexible hose which connects the inlet of the sprinkler lateral to any one of a plurality of main line outlets which are spaced at intervals along the main supply line. The transverse sprinkler lateral is then linearly advanced across the field while being supplied with pressurized water. More technologically advanced linear systems utilize two flexible line connectors which are automatically connected to the main line outlets one after the other.

A third irrigation system to which the present invention is relevant is the stationary irrigation system, which is essentially a series of fixed, or manually movable irrigation pipe laterals connected to a main irrigation supply line and having a plurality of spaced apart risers and sprinkler heads for distributing water over the field. In these systems, the main irrigation supply line functions as a supply manifold, with each of the fixed sprinkler laterals having a supply valve.

A fourth type of irrigation system is the wheel line irrigation system. Like the linear move system, the wheel line irrigation system utilizes a main irrigation water supply line positioned along one side or the center of the field and a sprinkler lateral, supported at spaced intervals by wheels which typically use the sprinkler lateral pipe as a common axle for movement transversely across the field. Unlike the linear move system, the wheel line is moved from one mainline outlet position to the next, and then stopped and held stationary while irrigating a particular transverse zone of the field. In this aspect, the wheel line system is similar to a solid set hand move system in that the sprinklers are stationary at the time that water is being distributed across a particular zone of the field.

Each of the four systems described is designed for, and often times incorporates features enabling the introduction of chemicals, be they nutrients, fertilizers, pesticides or other types of agricultural chemicals, into the irrigation water being sprinkled over the field. There are currently two types of sprinkler heads in common use today with the various sprinkler systems described. The first is the impact drive sprinkler which requires a relatively high pressure supply of water and a spring-loaded impact arm, which repeatedly impinges upon the flow of water from the sprinkler nozzle to rotate the sprinkler head about a central axis. The second type of sprinkler assembly uses passive baffle plates, wherein a stream of water is discharged through a nozzle and impinges upon a fixed or rotating distribution baffle which disperses the water over the zonal surface area below the irrigation lateral. The present invention relates to this second type of sprinkler head.

One of the important design parameters in each of the four types of systems is the ability to deliver a uniform supply of water across the entire field. The problem, however, is that it is not necessarily appropriate to uniformly distribute irrigation water, and/or chemicals, across the entire field. Large agricultural fields often times present varying soil types, topography, soil depth, fertility, and insect and weed population density. These characteristics, among others, determine any given field's "spatial variability".

For example, one portion of the field may contain thin sandy soil with low water holding capacity from which water drains easily. Another portion of the field, usually at the bottom of a drainage may contain a deeper sand, clay and silt mixture, which drains slowly and holds water and chemicals for a longer period of time. In such cases, the farmer is faced with the dilemma of having too little water in one portion of the field and too much at the other, if the irrigator applies water uniformly at a rate equal to the average required over the field. In practice, the farmer typically irrigates the entire field at the rate required for the most deficient soil in the field wasting water in those areas having low capacity soil and where leaching occurs. The problems are further compounded by the over application of agricultural chemicals to given areas based upon the requirements of the chemically deficient soil resulting in leaching of soluble and mobile chemicals into ground water or waste water recovery systems.

A method and apparatus for cataloging or dividing a given irrigated field into a plurality of zones and then delivering by means of the irrigation system the optimum amount of irrigation water and/or chemicals to each zone as so defined is disclosed and claimed in McCann et. al. The McCann apparatus discloses a plurality of sprinkler assemblies each independently controlled by a solenoid operated valve to operate either in an open full flow position of an off, no-flow position. What is needed is an apparatus which will expand the potential of the McCann system to distribute an adjustable amount of water over a zone by providing means for alternating the flow of the sprinkler head without reducing uniformity of application within a given.

Therefore, a first object of the present invention is to provide a sprinkler head which may be used as one of a plurality of independently operable sprinkler assemblies oriented in a fixed array relative to each other, with each of the sprinkler assemblies being operable to distribute an adjustable amount of water over a zone of ground by providing means for alternating the flow of the sprinkler head between a variety of preselected flow rates as a means for addressing the problem of spatial variability.

While there have been developments in sprinkler design, they have focused on the areas of distribution patterns, application rates and reduction in operating pressure. What has not changed is the basic premise that the flow rate from a given sprinkler head should be constant depending only on pressure and orifice size. Thus, system-wide, distribution patterns are still determined in many systems simply by the spacing of spray assemblies and nozzle size.

While current production model movable systems are capable of varying their speed, and hence irrigation rate, as they traverse a field, they can be programmed only to apply different irrigation amounts to different sectors of the field. However, it is rare that spatial variability conforms to regular sections or patterns. Consequently, an entire field or section may be treated as a single management zone at any given time requiring uniform water and/or chemical applications. Irrigation management is still therefore viewed as one or two dimensional as opposed to "multi-dimensional". Multi-dimensional irrigation management allows for the unique characteristics of any given area of a field to be considered in determining the irrigation requirements for that area and regulating output not only by the speed of the system and distribution pattern, but also by regulating the flow for any given area.

A major limitation to sprinkler irrigation performance is the inability of current irrigation systems to address the spatial variability inherent within individual fields. The best available systems are capable of applying relatively uniform amounts of water and/or chemicals to all fields. However, where fields are nonuniform, which is most often the case, problems of reduced application efficiency occur as a result of the spatial variability associated with such fields. While uniformity in and of itself may be a desirable characteristic, the amount of water applied to any given area may not match the needs of the particular area due to the limitations of one-dimensional management. Therefore, an objective of the present invention is to provide means for implementing a system which allows for "multi-dimensional" irrigation management or the management of multiple management zones at any given time, by providing a single sprinkler head which allows for varying flow rate. Attempts have been made to address the problems which characterize spatial variability. Current technology for center pivot and linear move systems employs a system wherein the original individual spray heads on the system are replaced with a two or three spray heads, each with different fixed flow rates. Each spray head in the configuration can be independently turned on or off, resulting in different flow rates in addition to zero from the different on/off combinations. Therefore, a third objective of the present invention is to provide means for adapting existing low and medium pressure sprinkler heads to provide variable flow between predetermined upper and lower limits. One method of varying average flow rate over a period of time is to "pulse" the flow by alternately turning the flow on and off within a duty cycle. However, this can have a significant impact on application uniformity depending upon size of the sprinkler wetted pattern, speed of system movement, and pulsing cycle duration. The present invention overcomes some of these problems by allowing the flow rate of the sprinkler to be varied over an effective range without adversely impacting uniformity. This is because the sprinkler wetted pattern at the predetermined reduce flow rate is only slightly reduced (not off) and remains symmetrical. Thus, uniformity can be maintained at increased cycle durations and greater system speeds. The increased pulsing cycle duration means reduced cycling which translates into increased reliability. Increased system speed allows for greater management flexibility.

Finally, it would be desirable to provide for an apparatus which includes both the feature of varying flow rate by alternating the flow of the sprinkler head between a variety of preselected flow rates together with a feature which allows the sprinkler head to be shut entirely off. Therefore, it is another object of the present invention to provide an apparatus which includes both the feature of varying flow rate by alternating the flow of the sprinkler head between a variety of preselected flow rates together with a feature which allows the sprinkler head to be shut entirely off.

SUMMARY OF THE INVENTION

According to the present invention, these and other objects are achieved by a variable flow passive baffle plate sprinkler head having a nozzle, the nozzle having an orifice therein, the cross sectional area of the orifice being changeable by alternately inserting or removing a needle into the sprinkler head nozzle orifice. When the needle is removed full flow occurs. When the needle is fully inserted into the center of the nozzle, the cross sectional area is effectively reduced by an amount equal to the cross sectional area of the needle. Flow is thus reduced to a predetermined lower limit when the needle is inserted, and a variable flow rate between the lower limit and full flow can be achieved by "cycling" or pulsing the needle in and out of the nozzle on a duty cycle. In this manner, the present invention provides a time averaged flow rate between the two preset flow rates. For example, if inserting the needle reduced flow to 40% of its full value, a flow rate equal to 85% could be achieved by inserting the needle for 15 seconds and removing it for 45 seconds during a one minute duty cycle.

In a first embodiment, the variable flow sprinkler head is adapted to an existing sprinkler head thereby allowing conversion of existing systems.

The first embodiment of the variable flow sprinkler head includes of an adapter for a sprinkler head consisting of a body which has two threaded openings, an upper opening or inlet and a lower opening or outlet. A means for cycling the needle, or linear actuator is affixed to the top of the body, centered above the outlet. A streamlined centering insert is friction fit into the bottom threaded opening and a sprinkler head is screwed in place below the insert. The linear actuator is spring loaded to automatically retract the needle in an inactive or de-energized state. The needle length and diameter are sized to fit the sprinkler head and nozzle size employed to provide a predetermined flow rate reduction when the needle is inserted into the nozzle orifice.

In one embodiment of the invention the linear actuator comprises an electric solenoid. In another embodiment of the invention the linear actuator comprises a two position hydraulic actuator operatively connected to a two-position spool valve. In yet another embodiment of the invention the linear actuator comprises a three position hydraulic actuator operatively connected to a spool valve which allows the sprinkler to be operated between either of two preselected flow rates or in the alternative to be shut off completely. The primary advantage of the hydraulic actuated sprinkler is that the power needed to "pulse" the sprinkler is provided by the already present pressurized water. Thus, voltages of 12–24 volts with small currents can be used to "pulse" the sprinkler by simply controlling pressures applied to the hydraulic actuator ports. The low voltages and current is desirable for human safety in the wet conditions and reduced cost of electrical components.

In yet another embodiment of the invention, the linear actuator comprises a pneumatic actuator although this embodiment is not considered preferred as the size of diaphragm required to generate adequate performance given vacuums that may be generated by low and medium pressure water sources has proven awkward and marginally acceptable.

Common to any of the specified linear actuator is an extendable and retractable portion or piston configured to move axially along the longitudinal axis of the outlet and the nozzle and a needle having a longitudinal axis common to the longitudinal axis of the nozzle, attached to the extendable and retractable portion of the linear actuator to extend and retract a second end of the needle into and out of the orifice of nozzle.

In any case, the linear actuator is activated by an electrical signal provided by control module. The control module is separate from the variable flow sprinkler and is similar to that of McCann et al. patent. The control module is an active electronic component capable of decision making. It maintains communication with a central microprocessor through some form of wired connection. This wired connection could be separate or take the form of a power line interface to the existing wiring on the center pivot system. The control module monitors addressed instructions issued by the control microprocessor. When its address is detected, it reads the instruction and performs the appropriate action. In the case of the solenoid actuator, a single on/off output is used to energize/de-energize the solenoid coil. The timing of the duty cycle for "pulsing" could be determined either by the central microprocessor or the control module. The control module can control more than one sprinkler by wiring several sprinklers in parallel or control several sprinklers individually by having multiplexed controlled outputs.

The variable flow sprinkler head achieves the objectives of the present invention by providing a system which allows for "multi-dimensional" irrigation management, increasing application efficiency in irrigation by addressing the problem of spatial variability, providing a means for adapting existing low and medium pressure sprinkler heads for moveable and stationary systems to provide variable flow between predetermined upper and lower limits.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Referring now to FIGS. 1 through 7, various features of the present invention may be more fully appreciated.

Figure 1:
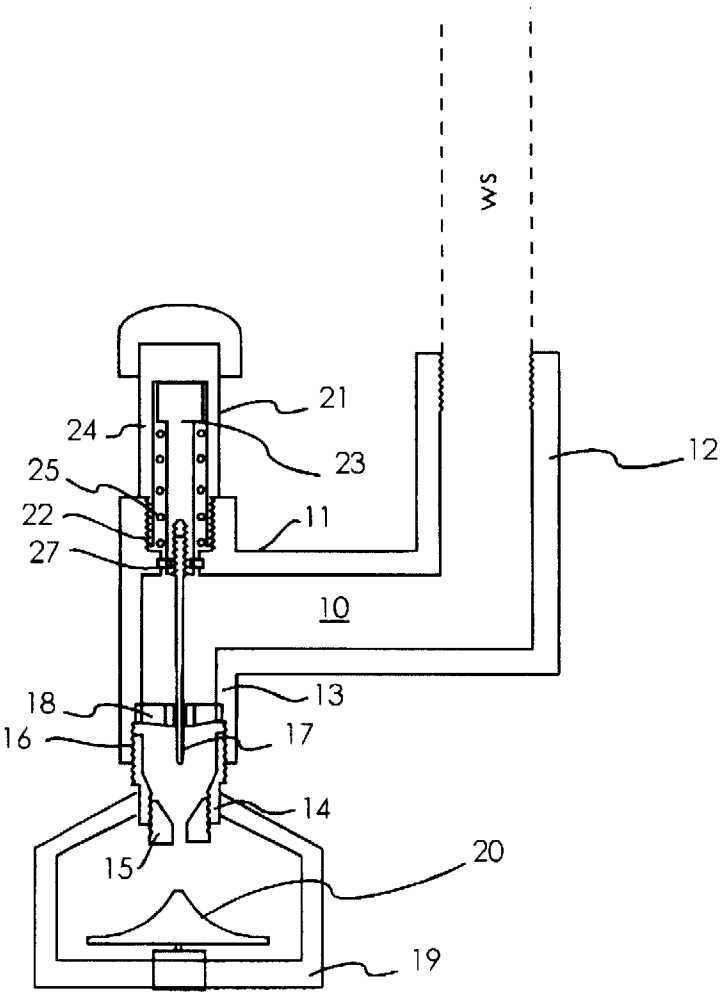
FIG. 1 is a cross-sectional representation of a first embodiment of the present invention in an open full flow position.
Figure 2:
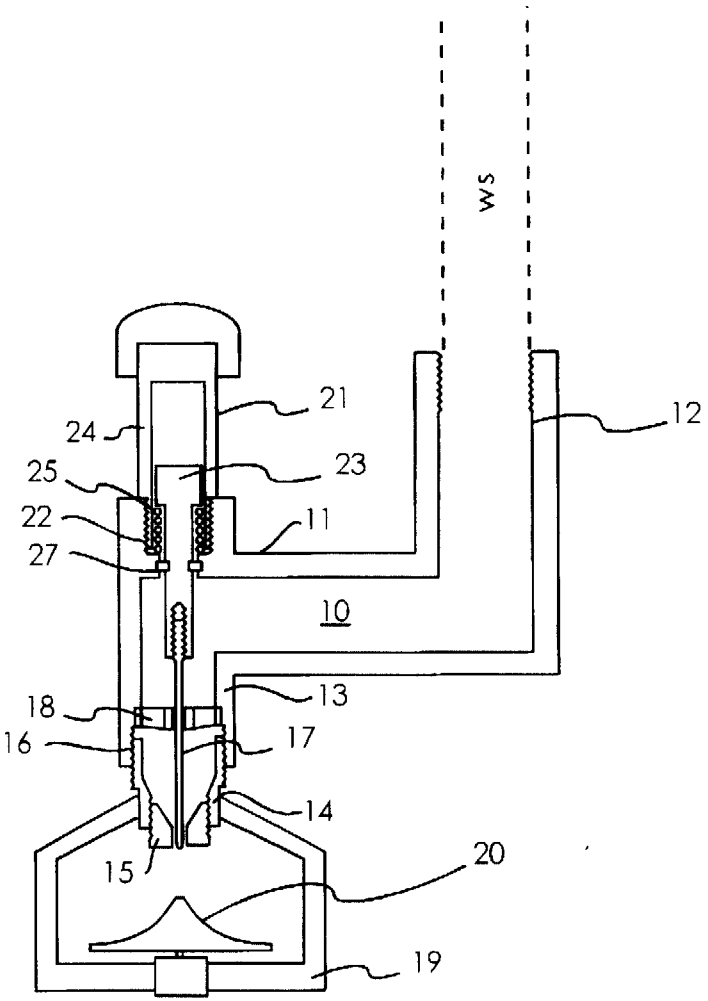
FIG. 2 is a cross-sectional representation of the first embodiment of the present invention in a reduced flow position.

In the first embodiment of the present invention shown in FIGS. 1 and 2, variable flow sprinkler head 10 has body 11 having two threaded openings, inlet 12 and outlet 13. Nozzle 14 having orifice 15 therein is coupled to outlet 13 by means of threaded nozzle/outlet coupling 16. Similarly, variable flow sprinkler head 10 is removably attached to pressurized water source WS by threaded coupling means located within the end of inlet 12.

Solenoid actuator 21 is removably attached to body 11 by solenoid actuator/body coupling 22 which allows removal of solenoid actuator 21 for service and or replacement as required. Solenoid actuator 21 is positioned relative to outlet 13 so that when coil 24 is energized, armature 23 extends axially along a longitudinal axis which is common to armature 23, outlet 13, nozzle 14 and therefore orifice 15. Seal 27 isolates solenoid actuator 21, coil 24 and armature 23 from the water present in body 11. Solenoid actuator 21 is connected to a conventional power source and control module (not shown), and is activated by an electrical signal.

Needle 17 is removably attached within the end of armature 23, also extending axially along the longitudinal axis which is common to needle 17, outlet 13, nozzle 14 and orifice 15. The length and diameter of needle 17 are sized in order to provide a predetermined flow rate reduction when needle 17 is inserted into orifice 15. Needle 17 passes through the center of centering insert 18 which serves to stabilize needle 17 axially along its centerline. Centering insert 18 is streamlined and friction fit into outlet 13. Spring 25 of solenoid actuator 21 is biased to automatically retract needle 17 when coil 24 is de-energized.

Attached to and extending below nozzle 14 is sprinkler head 19. Removably attached to sprinkler head 19 and located directly opposite and downstream of orifice 15 is baffle 20 which dictates, to a large extent, the pattern of spray emitted by variable flow sprinkler head 10.

In operation, variable flow sprinkler head 10 is attached to an existing pressurized water source WS by threaded coupling means located within the end of inlet 12. Water flows through inlet 12 through body 11 and out outlet 13 passing through nozzle 14 and orifice 15. Water exiting via orifice 15 impinges upon baffle 20 causing a spray of a chosen pattern to be emitted.

Flow through orifice 15 may be reduced by operation of solenoid actuator 21. Solenoid actuator 21 is activated by an electrical signal which operates coil 24 which in turn causes armature 23 to extend axially along a longitudinal axis which is common to needle 17, outlet 13, nozzle 14 and orifice 15. Needle 17 is thereby extended axially into orifice 15 as shown in FIG. 2. In a constant pressure system, flow of water through orifice 15 is reduced by an amount proportional to the difference between the cross-sectional diameter of orifice 15 minus the cross-sectional diameter of needle 17.

When coil 24 is de-energized, spring 25 automatically retracts needle 17 from orifice 15 and a full flow rate is resumed as shown in FIG. 1.

Figure 3:
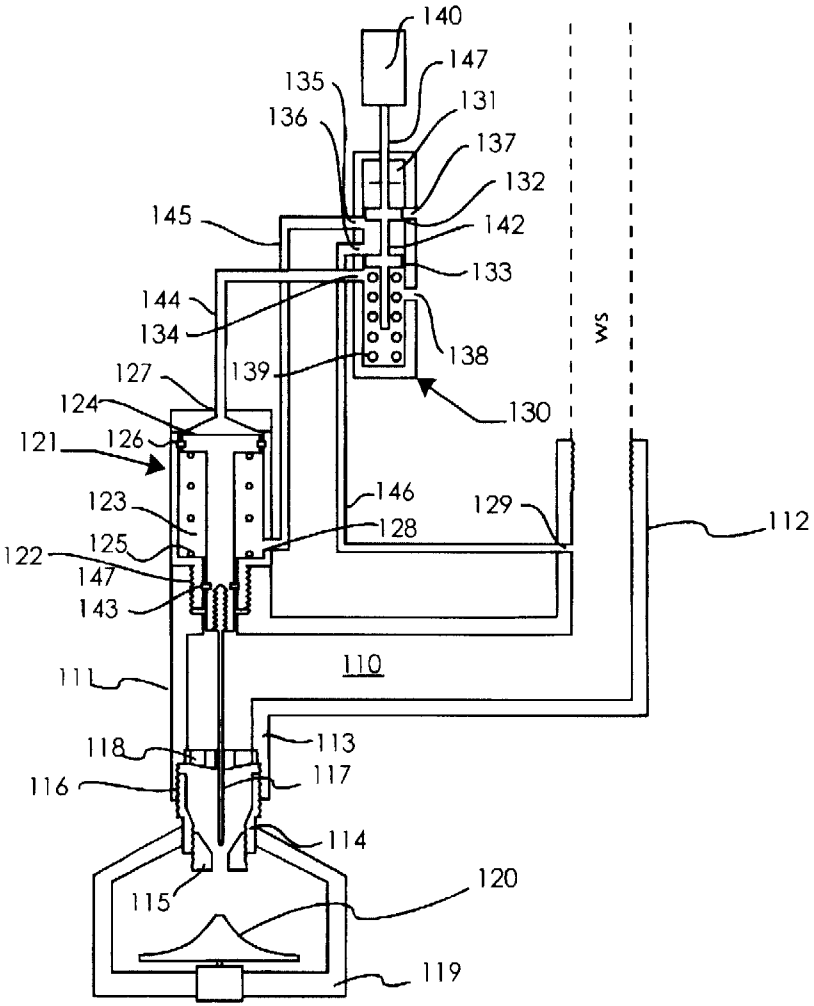
FIG. 3 is a cross-sectional representation of an alternate embodiment of the present invention in an open full flow position.
Figure 4:
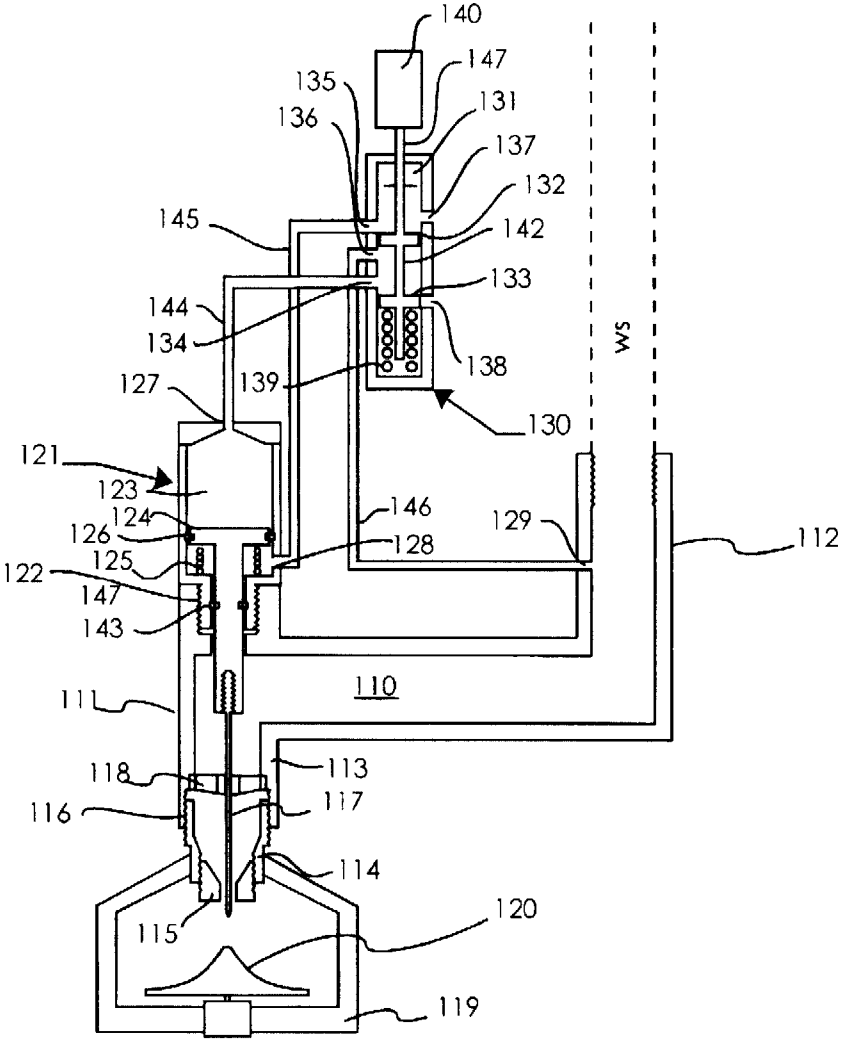
FIG. 4 is a cross-sectional representation of an alternate embodiment of the present invention in a reduced flow position.

An alternative embodiment of the invention is shown in FIGS. 3 and 4 as variable flow sprinkler head 110. Variable flow sprinkler head 110 similarly has body 111 having two threaded openings, inlet 112 and outlet 113. Nozzle 114, having orifice 115 therein is coupled to outlet 113 by means of threaded nozzle/outlet coupling 116. Variable flow sprinkler head 110 is removably attached to pressurized water source WS by threaded coupling means located within the end of inlet 112. Located in inlet 112 is supply port 129.

In the alternative embodiment of the invention as shown in FIGS. 3 and 4, linear travel of needle 117 is effected by hydraulic actuator 121. Hydraulic actuator 121 is removably attached to body 111 by hydraulic actuator/body coupling 122 which allows removal of hydraulic actuator 121 for service and replacement as required. Hydraulic actuator 121 comprises in actuator cylinder 123 in which actuator piston 124 is slideably disposed. Actuator piston 124 has actuator piston stem 147 which is extendable below actuator cylinder 123 and into body 111. Piston seal 126 seals actuator piston 124 within actuator cylinder 123 while piston stem seal 143 prevents loss of fluid pressure between actuator cylinder 123 into body 111.

Located within body 111 at the top end of actuator cylinder 123 is actuator first port 127. At the bottom or lower end of actuator cylinder 123, actuator second port 128 is located.

Needle 117 is removably attached within the distal or lower end of actuator piston stem 147, and is extendable axially along the longitudinal axis which is common to needle 117, outlet 113, nozzle 114 and therefore orifice 115. Needle 117 passes through the center of centering insert 118 which serves to stabilize needle 117 axially along its longitudinal axis. Similar to the embodiment previously described, spring 125 of hydraulic actuator 121 is biased to automatically retract needle 117.

Spool valve 130 is a two-position valve having a spool valve cylinder 131 having first valve port 134, second valve port 135, third valve port 136, first vent 137 and second vent 138 therein. Spool valve piston 142 having spool valve piston stem 147, first valve land 132 and second valve land 133 is slideably disposed within spool valve cylinder 131. Spool valve piston stem 147 is operatively connected at its first or upper end to spool valve solenoid actuator 140 which in turn is connected to a conventional power source and control module (not shown). Spool valve return spring 139 is biased to return spool valve piston 142 to a position which allows needle 117 to retract from orifice 115 by relief of pressure above actuator piston 124 within actuator cylinder 123. Operation of variable flow sprinkler head 110 is more fully discussed herein below.

Hydraulic actuator 121 is fluidly connected to spool valve 130 via first valve port 134 which is in fluid communication with actuator first port 127 via actuator first port/first valve port line 144. Similarly, second valve port 135 is in fluid communication with actuator second port 128 through actuator second port/second valve port line 145. Water pressure is provided to hydraulic actuator 121 by water from the pressurized water source WS which is diverted via supply port 129 located in inlet 112 through supply port/third valve port line 146 and third valve port 136 to spool valve 130.

Hydraulic actuator 121 is positioned relative outlet 113 such that when water pressure is applied through actuator first port 127 by operation of spool valve 130, actuator piston 124 extends axially along the longitudinal axis which is common to actuator piston 124, outlet 113, nozzle 114 and orifice 115.

Attached to and extending below nozzle 114 is sprinkler head 119. Removably attached to sprinkler head 119 and located directly opposite and downstream of orifice 115 is baffle 120 which influences the pattern of spray emitted by variable flow sprinkler head 110.

In operation, variable flow sprinkler head 110 is attached to an existing pressurized water source WS by threaded coupling means located within the end of inlet 112. Water flows through inlet 112 through body 111 and out outlet 113 passing through nozzle 114 and orifice 115. Water exiting via orifice 115 impinges upon baffle 120.

Needle 117 is extended axially along the longitudinal axis which is common to needle 117 and orifice 115 by operation of hydraulic actuator 121. Hydraulic actuator 121 operates by varying the relative water pressure above and below actuator piston 124 within actuator cylinder 123.

Projecting needle 117 into orifice 115 is accomplished by energizing spool valve solenoid actuator 140 forcing spool valve piston 142 to extend within spool valve cylinder 131. In this position, first valve land 132 blocks flow through second valve port 135 as shown in FIG. 4 and the water which is diverted through supply port 129, passing through supply port/third valve port line 146 and third valve port 136 into spool valve 130 passes into spool valve cylinder 131, exits through first valve port 134 into actuator first port/first valve port line 144 and actuator first port 127 into actuator cylinder 123 increasing water pressure on the top side of actuator piston 124. This forces actuator piston 124 with its attached needle 117 to project into orifice 115 as shown in FIG. 4.

During this phase, any water present or remaining in the lower end of actuator cylinder 123 is forced by the increasing pressure in the top end of actuator cylinder 123 above actuator piston 124, to evacuate actuator cylinder 123 through actuator second port 128, through actuator second port/second valve port line 145 and second valve port 135 into spool valve 130 exiting to atmosphere via first vent 137.

To retract needle 117 from orifice 115 as shown in FIG. 3, spool valve solenoid actuator 140 is de-energized allowing spool valve return spring 139 to expand forcing spool valve piston 142 to retract within spool valve cylinder 131. In this position, second valve land 133 blocks flow through first valve port 134 and water is diverted through second valve port 135 into actuator second port/second valve port line 145 entering actuator cylinder 123 through actuator second port 128 increasing water pressure below actuator piston 124, causing actuator piston 124, assisted by spring 125 to retract with its attached needle 117 from orifice 115 as shown in FIG. 3.

During this phase, any water present or remaining in the upper end of actuator cylinder 123 is forced by the increasing pressure in the bottom end of actuator cylinder 123 below actuator piston 124, to evacuate actuator cylinder 123 through actuator first port 127, through actuator first port/first valve port line 144, through spool valve 130 exiting to atmosphere via second vent 138.

Figure 5:
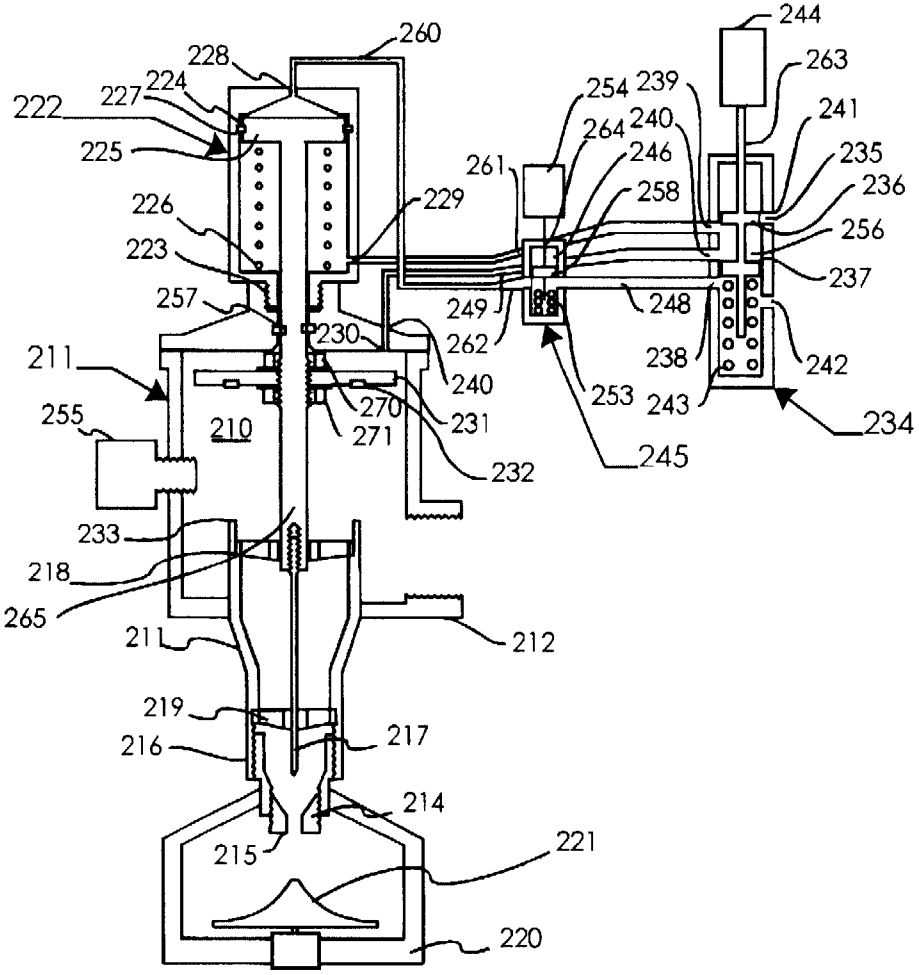
FIG. 5 is a cross-sectional representation of an alternate embodiment of the present invention in an open full flow position.
Figure 6:
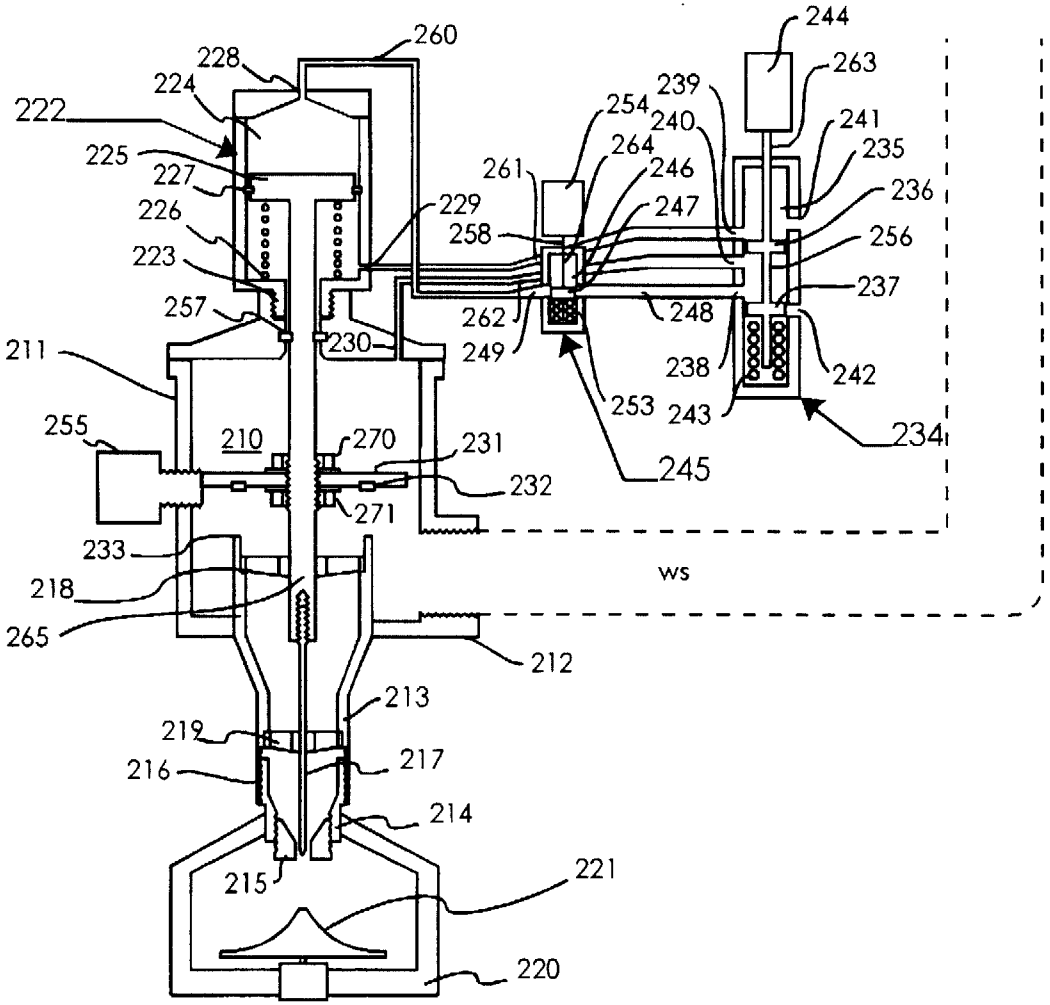
FIG. 6 is a cross-sectional representation of an alternate embodiment of the present invention in a reduced flow position.
Figure 7:
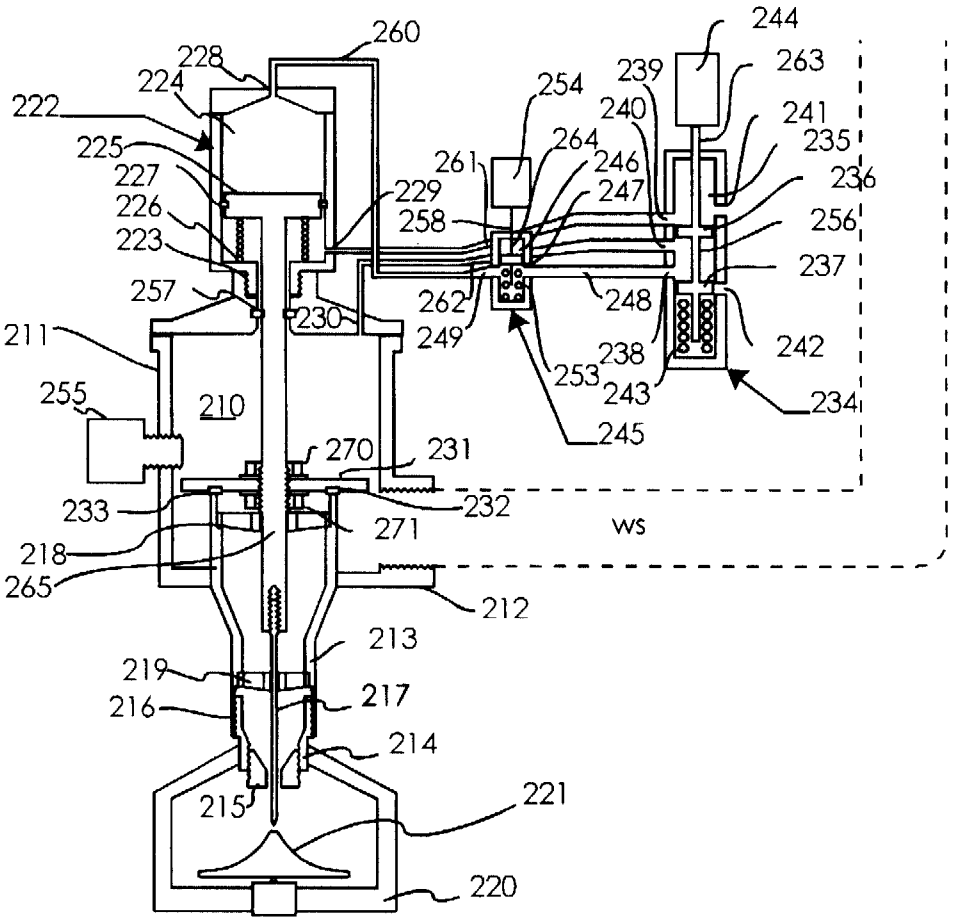
FIG. 7 is a cross-sectional representation of an alternate embodiment of the present invention in a shut-off position.

A second alternative embodiment of the invention is shown in FIGS. 5, 6 and 7 as variable flow sprinkler head 210. Variable flow sprinkler head 210, similar to the previously described embodiments, includes of body 211 having two threaded openings, inlet 212 and outlet 213. Nozzle 214 is coupled to outlet 213 by means of threaded nozzle/outlet coupling 216 and comprises in part orifice 215. Similarly, variable flow sprinkler head 210 is removably attached to pressurized water source WS by threaded coupling means located within the end of inlet 212.

In the second alternative embodiment of the invention shown in FIGS. 5, 6 and 7, linear travel of needle 217 is effected by hydraulic actuator 222. Hydraulic actuator 222 is removably attached to body 211 by hydraulic actuator/body coupling 223 which allows removal of hydraulic actuator 222 for service and replacement as required. Hydraulic actuator 222 is formed having actuator cylinder 224 in which actuator piston 225 is slideably disposed. Actuator piston 225 has actuator piston stem 265 which is extendable below actuator cylinder 224 into body 211 and to which shut off flange 231 is secured by means of upper locknut assembly 270 and lower locknut assembly 271. Shut off flange 231 is provided with shut off seal 232 which mates with shut off seat 233 when hydraulic actuator 222 forces actuator piston 225 to a fully closed position as shown in FIG. 7. Piston seal 227 seals actuator piston 225 within actuator cylinder 224, while piston stem seal 257 prevents loss of fluid pressure between actuator cylinder 224 into body 211.

Located within body 211 at the top end of actuator cylinder 224 is actuator first port 228. At the bottom or lower end of actuator cylinder 224, actuator second port 229 is located.

Needle 217 is removably attached within the end of actuator piston stem 265, and extends axially along the longitudinal axis which is common to needle 217, outlet 213, nozzle 214 and therefore orifice 215. Actuator piston stem 265 passes through the center of first centering insert 218 while needle 217 similarly passes through the center of second centering insert 219. This structure serves to stabilize needle 217 axially along its longitudinal axis. Similar to the embodiment previously described, spring 226 of hydraulic actuator 222 is biased to automatically retract needle 217 when pressure is relieved from the top end of actuator cylinder 224.

First spool valve 234 is a two-position, four-way valve having first spool valve cylinder 235 having first spool valve first port 238, first spool valve second port 239, first spool valve third port 240, first spool valve first vent 241 and first spool valve second vent 242 therein. First spool valve piston 256 comprises in part first spool valve piston stem 263, first spool valve first valve land 236 and first spool valve second valve land 237 and is slideably disposed within first spool valve cylinder 235. First spool valve piston stem 263 is operatively connected at its first or upper end to first spool valve solenoid actuator 244 which in turn is connected to a conventional power source and control module (not shown). First spool valve return spring 243 is biased to return first spool valve piston 256 to a position which allows needle 217 to retract from orifice 215 by relief of pressure within actuator cylinder 224 when second spool valve 234 is de-energized. Operation of variable flow sprinkler head 210 is more fully discussed herein below.

First spool valve first port 238 is fluidly connected to second spool valve 245 by means of first spool valve/second spool valve crossover line 248. Second spool valve 245 is a two-position, two-way valve comprising in part second spool valve cylinder 246 having second spool valve port 249. Second spool valve piston 258 is slideably disposed within second spool valve cylinder 246 and comprises in part second spool valve piston stem 264 and second spool valve land 247. Second spool valve piston stem 264 is operatively connected at its first or upper end to second spool valve solenoid actuator 254 which in turn is connected to a conventional power source and control module, (not shown). Second spool valve return spring 253 is biased to return second spool valve piston 246 to a position which allows needle 217 to retract from orifice 215 by relief of pressure within actuator cylinder 224 when second spool valve 245 is de-energized.

Hydraulic actuator first port 228 is fluidly connected to second spool valve port 249 via actuator first port/second spool valve port line 260. Similarly, first spool valve second port 239 is fluidly connected to hydraulic actuator second port 229 via actuator second port/first spool valve second port line 261. Water pressure is provided to hydraulic actuator 222 by water from the pressurized water source WS which is diverted via supply port 230 supply port/first spool valve third port line 262 to first spool valve third port 240.

Hydraulic actuator 222 is positioned relative outlet 213 such that when water pressure is applied through actuator first port 228, actuator piston 225 extends axially along a longitudinal axis which is common to actuator piston 225, outlet 213, nozzle 214 and orifice 215.

Attached to and extending below nozzle 214 is sprinkler head 220. Removably attached to sprinkler head 220 and located directly opposite and downstream of orifice 215 is baffle 221.

In operation, variable flow sprinkler head 210 is attached to an existing pressurized water source WS by threaded coupling means located within the end of inlet 212. As in the embodiments previously described, water flows through inlet 212 through body 211 exiting via outlet 213 passing through nozzle 214 and orifice 215 impinging upon baffle 221.

Needle 217 is extended axially along the longitudinal axis which is common to needle 217 and therefore orifice 215 by operation of hydraulic actuator 222.

Projecting needle 217 into orifice 215 is accomplished by energizing first valve solenoid actuator 244 forcing first spool valve piston 256 to extend within first spool valve cylinder 235 as shown in FIG. 5. In this position, first spool valve first land 236 blocks flow of fluid through first spool valve second port 239 and water flow is diverted through first spool valve third port 240 into first spool valve/second spool valve crossover line 259, through second spool valve 245 which during this phase has not been energized and remains in the open position allowing water to flow freely through second spool valve port 249, through actuator first port/second spool valve port line 260 and actuator first port 228 and into actuator cylinder 224 increasing water pressure on the top side of actuator piston 225, forcing actuator piston 225 with its attached needle 217 to project into orifice 215.

When electronic proximity sensor 255 senses that shut off flange 231 has reached a midpoint of travel as shown in FIG. 6, indicating that needle 217 has inserted into orifice 215 thereby restricting flow through orifice 215, second spool valve solenoid actuator 254 is energized operating second spool valve 245, extending second spool valve piston 258 within second spool valve cylinder 246 causing second spool valve land 247 to block second spool valve port 249, as shown in FIG. 6, causing travel of actuator piston 225 to cease. During this phase, any water present or remaining in the lower end of actuator cylinder 224 is forced by the increasing pressure in the top end of actuator cylinder 224 and the movement of actuator piston 225 to evacuate actuator cylinder 224 through actuator second port 229, through actuator second port/first spool valve second port line 261 and first spool valve second port 239 into first spool valve 234 exiting to atmosphere via first spool valve first vent 241.

To restrict flow through variable flow sprinkler head 210 entirely as shown in FIG. 7, second spool valve solenoid actuator 254 is de-energized allowing second spool valve piston 258 within second spool valve cylinder 246 to retract by operation of second spool valve spring 253 which is biased to return second spool valve piston 258 to the top end of second spool valve cylinder 246. Flow of water through second spool valve 245 resumes as shown in FIG. 7, forcing water through second spool valve port 249 and actuator first port 228 into actuator cylinder 224 increasing water pressure on the top side of actuator piston 225, forcing actuator piston 225 with its attached needle 217 to project further into orifice 215 until shut off flange 231 with shut off seal 232 shut off seat 233 terminating flow of water through variable flow sprinkler head 210.

To resume flow of water and to retract needle 217 from orifice 215, first spool valve solenoid actuator 244 is de-energized allowing first spool valve return spring 243 to expand forcing first spool valve piston 256 to retract within first spool valve cylinder 235 as shown in FIG. 5. In this position, first spool valve second land 237 blocks flow through first spool valve first port 238 and water from first spool valve third port 240 is diverted through first spool valve second port 239 into actuator second port/first spool valve second port line 261 entering actuator cylinder 224 through actuator second port 229 increasing water pressure below actuator piston 225, causing actuator piston 225 with its attached shut off flange 231, assisted by spring 226, to lift away from shut off seat 233 retracting needle 217 from orifice 215.

During this phase, any water present or remaining in the upper end of actuator cylinder 224 is forced by the increasing pressure below actuator piston 225 to evacuate actuator cylinder 224 through actuator first port 228, through actuator first port/second spool valve port line 260, through second spool valve 245, through first spool valve/second spool valve crossover line 259, through first spool valve 234 exiting to atmosphere via first spool valve second vent 242.

While the preferred embodiment of the invention is shown and described, it is to be distinctly understood that this invention is not limited thereto but may be variously embodied to practice within the scope of the following claims.

We claim:

1. A variable flow rate sprinkler for connection to, and use with, a pressurized water source comprising:

a body having an inlet for connection to the pressurized water source and an outlet in fluid communication with the inlet, the outlet having a longitudinal axis;

a nozzle disposed within the outlet and having a longitudinal axis, the nozzle having an orifice therethrough, the orifice centered along the longitudinal axis of the nozzle;

a linear actuator attached to the body and having an extendable and retractable portion configured to move axially along the longitudinal axis of the outlet and the nozzle;

a needle having a longitudinal axis common to the longitudinal axis of the nozzle, the needle having a first end attached to the extendable and retractable portion of the linear actuator to extend and retract a second end of the needle into and out of the orifice of nozzle; and a sprinkler head attached to the outlet, the sprinkler head having a baffle configured to distribute water from the pressurized water source.

2. The variable flow rate sprinkler of claim 1 wherein the linear actuator comprises a solenoid actuator.

3. The variable flow rate sprinkler of claim 1 wherein said linear actuator comprises a hydraulic actuator.

4. The variable flow rate sprinkler of claim 1 further comprising means for removably attaching said needle to the extendable and retractable portion of the linear actuator.

5. The variable flow rate sprinkler of claim 3 wherein the hydraulic actuator comprises:

the body having a supply port disposed within its inlet;

an actuator cylinder having top and bottom ends, the actuator cylinder having a first actuator port located in its top end and a second actuator port located in its bottom end;

an extendable and retractable portion slideably disposed within the actuator cylinder, the extendable and retractable portion having an actuator piston stem having a distal end extending below the actuator cylinder into the body, the needle first end being attached to the actuator piston stem distal end for extending and retracting the second end of the needle into and out of the orifice of nozzle; and a two way spool valve having a first valve port, a second valve port and a third valve port;

the first valve port being in selectable fluid communication with the actuator first port for providing water from the pressurized water source to the top end of the actuator cylinder for forcing the extendable and retractable portion having an actuator piston stem to slideably extend into the body;

the second valve port being in selectable fluid communication with the actuator second port for providing water from the pressurized water source to the bottom end of the actuator cylinder for forcing the extendable and retractable portion having an actuator piston stem to slideably retract from the body; the third valve port being in fluid communication with the supply port for providing water from the pressurized water source to the two way spool valve; and a two way spool valve actuator operatively connected to the two way spool valve for selectively operating the two way spool valve between a first position wherein the first valve port is in fluid communication with the actuator first port and a second position wherein the second valve port is in fluid communication with the actuator second port.

6. The variable flow rate sprinkler of claim 5 wherein the linear actuator further comprises means for shutting off flow of water from the pressurized water source.

7. The variable flow rate sprinkler of claim 6 wherein the means for shutting off flow of water further comprises:

the actuator piston stem having a shut off flange secured thereto by an upper locknut assembly and a lower locknut assembly;

a shut off seat attached to the nozzle and extending upward within the body, the shut off seat being located and configured so as to mate with the shut off flange when the extendable and retractable portion is positioned at the bottom end of the actuator cylinder; and a second spool valve in selectable fluid communication with the first spool valve first port and the actuator first port, for selectively controlling flow of water between the two way spool valve and the top end of the actuator cylinder; and a second spool valve actuator operatively connected to the second spool valve for selectively operating the second spool valve between a first position wherein the first valve port is in fluid communication with the actuator first port and a second position wherein the first valve port is not in fluid communication with the actuator first port.

8. A variable flow rate sprinkler for connection to and use with a pressurized water source, which comprises:

a body having an inlet for connection to the pressurized water source and an outlet in fluid communication with the inlet, the outlet having a longitudinal axis;

a nozzle disposed within the outlet and having a longitudinal axis common to the longitudinal axis of the outlet, the nozzle having an orifice therethrough which is centered along the longitudinal axis;

a needle having a longitudinal axis common to the longitudinal axis of said nozzle and first and second ends, the needle's second end being slideably projectable within the orifice of the nozzle; and means for cycling the needle in and out of the orifice on a duty cycle, the means for cycling being held within the body and operatively connected to the first end of the needle to extend the needle axially along its longitudinal axis.

9. A method for varying the flow rate of a sprinkler having a body, the body having an inlet for connection to the pressurized water source and an outlet in fluid communication with the inlet, the outlet having a longitudinal axis, a nozzle having an orifice therethrough, disposed within the outlet, the nozzle orifice having a longitudinal axis common to the longitudinal axis of the outlet and a sprinkler head attached to the outlet, the sprinkler head configured to distribute water from the pressurized water source, connected to and used with a pressurized water source comprising:

cycling the needle in and out of the orifice on a duty cycle, the means for cycling being held within the body and operatively connected to the first end of the needle to extend the needle axially along its longitudinal axis.

10. A variable flow rate sprinkler for connection to, and use with, a pressurized water source comprising:

a body having an inlet for connection to the pressurized water source and an outlet in fluid communication with the inlet, the outlet having a longitudinal axis, the body having a supply port disposed within its inlet;

a nozzle disposed within the outlet and having a longitudinal axis, the nozzle having an orifice therethrough, the orifice centered along the longitudinal axis of the nozzle;

a hydraulic actuator attached to the body and having an extendable and retractable portion configured to move axially along the longitudinal axis of the outlet and the nozzle, the hydraulic actuator including an actuator cylinder having top and bottom ends, the actuator cylinder having a first actuator port located in its top end and a second actuator port located in its bottom end;

an extendable and retractable portion slideably disposed within the actuator cylinder, the extendable and retractable portion slideably disposed within the actuator cylinder having an actuator piston stem having a distal end extending below the actuator cylinder into the body;

a two way spool valve having a first valve port, a second valve port and a third valve port, the first valve port being in selectable fluid communication with the actuator first port for providing water from the pressurized water source to the top end of the actuator cylinder for forcing the extendable and retractable portion having an actuator piston stem to slideably extend into the body, the second valve port being in selectable fluid communication with the actuator second port for providing water from the pressurized water source to the bottom end of the actuator cylinder for forcing the extendable and retractable portion having an actuator piston stem to slideably retract from the body, and the third valve port being in fluid communication with the supply port for providing water from the pressurized water source to the two way spool valve;

a two way spool valve actuator operatively connected to the two way spool valve for selectively operating the two way spool valve between a first position wherein the first valve port is in fluid communication with the actuator first port and a second position wherein the second valve port is in fluid communication with the actuator second port;

a needle having a longitudinal axis common to the longitudinal axis of the nozzle, the needle having a first end attached to the actuator piston stem distal end for extending and retracting the second end of the needle into and out of the orifice of nozzle; and a sprinkler head attached to the outlet, the sprinkler head having a baffle configured to distribute water from the pressurized water source.

11. The variable flow rate sprinkler of claim 10 wherein the hydraulic actuator further comprises a means for terminating flow of water from the pressurized water source through the nozzle.

12. The variable flow rate sprinkler of claim 10 wherein the means for terminating flow of water from the pressurized water source through the nozzle further comprises:

the actuator piston stem having a shut off flange secured thereto by an upper locknut assembly and a lower locknut assembly;

a shut off seat attached to the nozzle and extending upward within the body, the shut off seat being located and configured so as to mate with the shut off flange when the extendable and retractable portion is positioned at the bottom end of the actuator cylinder; and a second spool valve in selectable fluid communication with the first spool valve first port and the actuator first port, for selectively controlling flow of water between the two way spool valve and the top end of the actuator cylinder; and a second spool valve actuator operatively connected to the second spool valve for selectively operating the second spool valve between a first position wherein the first valve port is in fluid communication with the actuator first port and a second position wherein the first valve port is not in fluid communication with the actuator first port.

* * * * *

UNITED STATES PATENT AND TRADEMARK OFFICE

CERTIFICATE OF CORRECTION

PATENT NO. : 5,785,246

DATED : 07/28/98

INVENTOR(S) : King et al.

It is certified that error appears in the above-identified patent and that said Letters Patent is hereby corrected as shown below:

On the title page, item [73]:

Assignees: Idaho Research Foundation, Inc.
Moscow, ID
and
The United States of America as represented by
the Secretary of Agriculture
Washington, DC

Signed and Sealed this

Twenty-second Day of June, 1999

*Attest:*

Q. TODD DICKINSON

*Attesting Officer*

*Acting Commissioner of Patents and Trademarks*